US005079839A

United States Patent [19]

Conrad, Jr. et al.

[11] Patent Number: 5,079,839

[45] Date of Patent: * Jan. 14, 1992

[54] METHOD OF SEQUENTIALLY MOLDING A RAZOR CAP AND RAZOR UNIT

[75] Inventors: William T. Conrad, Jr., Shelton; Robert J. Qubick, Bridgeport; William E. Vreeland, Shelton; Vincent C. Motta, West Norwalk; David B. Braun, Ridgefield, all of Conn.

[73] Assignee: Warner-Lambert Company, Morris Plains, N.J.

[ * ] Notice: The portion of the term of this patent subsequent to Jul. 25, 2006 has been disclaimed.

[21] Appl. No.: 384,895

[22] Filed: Jul. 24, 1989

Related U.S. Application Data

[60] Continuation-in-part of Ser. No. 142,981, Jan. 12, 1988, abandoned, which is a division of Ser. No. 3,972, Jan. 16, 1987, Pat. No. 4,778,640.

[51] Int. Cl.[5] ..... B26B 19/44

[52] U.S. Cl. ..... 30/41; 30/90; 29/509; 252/10

[58] Field of Search ..... 30/41, 32, 90, 50; 264/249, 250, 273, 254, 255, 279; 29/509; 252/10

[56] References Cited

U.S. PATENT DOCUMENTS 4,170,821 10/1979 Booth ..... 30/41
4,624,051 11/1986 Aprille, Jr. et al. ..... 30/32 X
4,850,106 7/1989 Braun et al. ..... 30/41

*Primary Examiner*—Timothy V. Eley
*Assistant Examiner*—William Fridie, Jr.
*Attorney, Agent, or Firm*—Daniel A. Scola, Jr.; Richard S. Bullitt

[57] ABSTRACT

A razor unit and a method of forming the same having a skin-engaging portion and a sequentially molded shaving aid on the shaving unit wherein at least four anchoring openings are disposed substantially equidistant from each other.

15 Claims, 1 Drawing Sheet

METHOD OF SEQUENTIALLY MOLDING A RAZOR CAP AND RAZOR UNIT

BACKGROUND OF THE INVENTION

This application is a Continuation-In-Part Application of U.S. patent application Ser. No. 142,981 filed Jan. 12, 1988, now U.S. Pat. No. 4,850,106, issued July 25, 1989 which, in turn is a divisional of U.S. application Ser. No. 003,972, filed Jan. 16, 1987, which issued as U.S. Pat. No. 4,778,640 on Oct. 18, 1988.

The present invention relates to wet-shaving razor units which include a shaving aid, and, in particular, to such units which can be made with molded plastic material.

U.S. Pat. No. 4,170,821 to Booth, which issued Oct. 16, 1979, describes a razor cartridge having a cap with a lubricating composition. It also describes the incorporation of this agent in a water insoluble microporous substrate.

Commercially available razors of this type namely Gillette ATRA PLUS and Schick ULTREX PLUS provide the combination of a lubricating strip which is affixed to the razor cap. This strip, containing the shaving aid which is polyethylene oxide having a molecular weight between 100,000 and 6,000,000, is released from a microporous substrate, i.e., typically polystyrene by leaching.

The conventional process for manufacturing a razor having such a lubricating strip employs first, the injection molding of the cap and then the separate attachment of the strip. The strip is attached either by the use of adhesives, e.g. acrylate adhesives, or by mechanical means. When an adhesive is utilized, the strip and cap must be properly positioned after the adhesive is applied and then clamped for a period of time to allow the initial adhesive bonding to occur. This process has the disadvantage of the extra cost associated with the use of the adhesive as well as the separate steps utilized to mate and cure the adhesive.

A mechanical attachment means typically involves a slot defining a recess in the top surface of the razor cap generally extending longitudinally along the cap length and a positioning means either at the end of the recess, at the bottom of the recess, or in both places. The strip which is separately manufactured and which is either extruded or injection molded is cut, positioned and retained usually by means of tabs or the like which can be bent over a portion of the strip to retain it.

Ideally, the steps relating to the attachment of the separately formed strip and cap are avoided if the strip is molded in the same machine after the molding of the cap has been completed. While the mixture of polyethylene oxide and polystyrene can be rendered plastic and deformable, attempts to sequentially mold the polystyrene/polyethylene combination have run into some substantial difficulties.

One of the problems inherent in attempting to injection mold a polyethylene oxide compound is that high molecular weight polyethylene oxides are preferred for this particular application because they have the desired rate of water solubility. Lower molecular weight polyethylene oxide compounds, i.e., those near the bottom of the range disclosed in the above mentioned Booth patent, tend to rapidly leach out of the polystyrene open-celled matrix or honeycomb structure and may be essentially depleted before the number of shaves contemplated by the particular blade assembly have been completed.

The desired, high molecular weight polyethylene oxide is, unfortunately, highly susceptible to chain scission which reduces its molecular weight and consequently its efficacy as a shaving aid. In the thermoplastic state, high molecular weight polyethylene oxide has an extremely high melt viscosity. Therefore, in order to sequentially mold the lubricating strip onto the razor cap, it is necessary to use high injection molding temperatures and pressures to achieve the necessary melt flow to successfully complete the injection molding of the strip. The combination of high temperature, high pressure and shear exposure accelerate the degradation of the polyethylene oxide via chain scission. This problem could be substantially reduced if the temperatures used for injection molding were substantially reduced.

Another problem associated with the use of very high injection molding temperatures in a sequential molding process is the potential thermal distortion of the previously molded cap during the sequential molding of the lubricating strip.

A still further problem encountered when sequentially molding materials is the risk of mechanical distortion. For example, the resulting razor unit may be distorted by unequal forces acting on the unit as a result of the staggered shrinking of the different components which occur since the cooling processes for the separate components start at different times.

For these reasons, and the obvious energy savings, it is highly desirable to be able to substantially reduce the injection molding temperatures and pressures used to form the lubricating strip, and to solve the problems associated with mechanical distortion of the final razor unit.

SUMMARY OF THE INVENTION

In accordance with the present invention, a lubricating strip including a honeycomb structure of polystyrene and a water soluble shaving aid of high molecular weight polyethylene oxide is sequentially molded in situ on a skin engaging portion of a wet shaving unit, such as the razor cap, which is made of thermoplastic material that has been previously injection molded.

When the skin engaging portion is the cap of a wet shaving unit, the injection molding can be performed in such a manner that a suitable receptacle, such as a trough, is provided in the top surface of the cap for the lubricating strip to be sequentially molded therein. Alternatively, a lubricating strip which has been previously molded into a plastic insert can be attached to a razor cap by providing anchoring openings in the top of the cap and anchoring protrusions on the lower end of the insert having, for example, a T portion which extends from the lubricating strip bearing surface of the insert through the cap to the opposite side When the insert is connected to the razor cap, the top of the T portion bears against the opposite side of the cap while the leg of the T extends through the insert connecting the top of the T to the shaving aid strip. Alternatively, the top of the T portion may be disposed at least partially within a correspondingly shaped cavity within the insert.

It has now been found that the risks of mechanical distortion resulting from the staggered initial cooling times can be substantially overcome by locating at least four anchoring openings substantially equidistant from each other and in arrangement on the normal shaving assembly such that the forces imparted during cooling offset each other and reduce significantly the distortion imparting forces on the unit. In accordance with the present invention, a shaving aid, especially a lubricating strip including polyethylene oxide, can be sequentially molded to a wet shaving unit without fear of unduly distorting the product.

BRIEF DESCRIPTION OF THE DRAWINGS

The invention can be more readily understood by reference to the drawings in which.

DETAILED DESCRIPTION OF THE INVENTION AND DRAWINGS

Figure 1:
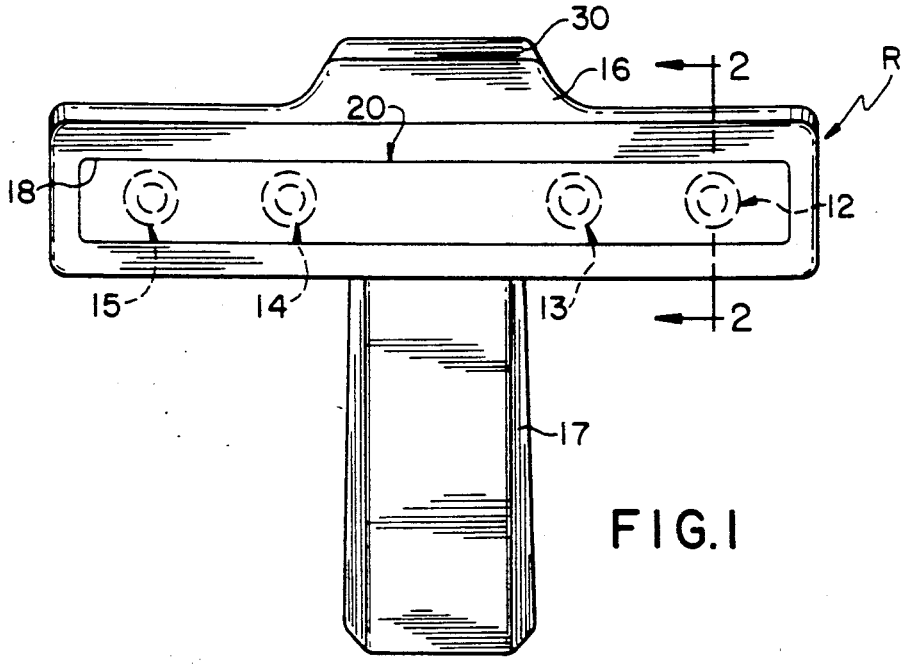
FIG. 1 is a plan view of a razor cap with lubricating insert.
Figure 2:
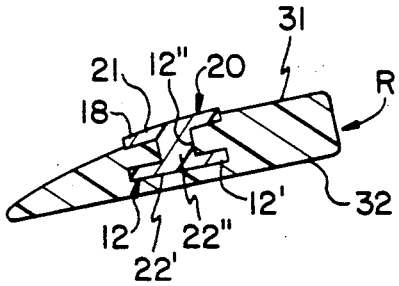
FIG. 2 is a cross sectional view taken along lines 2—2 of FIG. 1.

As can be seen from FIGS. 1 and 2, a razor structure R is provided with handle 17 connected to razor cap 30 by neck 16 (connecting means not shown). Razor cap 30 has a top portion 31 and a bottom portion 32. The lubricating strip 20 is deposited along a longitudinal line in a recess area 18 and is retained in place and anchored in anchor openings 12, 13, 14 and 15.

Figure 5:
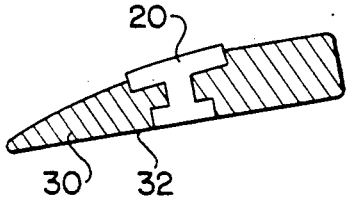
FIG. 5 is another cross sectional view taken along lines 2—2 of FIG. 1.

With particular reference to FIG. 2, anchor opening 12 may be generally T-shaped having a neck portion 12'' and a wider cross-bar portion 12'. Anchor openings 12, 13, 14 and 15 may terminate within cap 30 as shown in FIG. 2 or may extend through the cap and be anchored in recesses in the bottom side 32 of the cap as shown in FIG. 5. During the molding process, anchor opening 12 receives the flowable polystyrene-polyethylene oxide and, upon cooling, maintains the injection molded polystyrene-polyethylene oxide strip on the cap within recess 18.

While the present invention has been described as comprising a method of sequentially molding a lubricating strip 20 to a razor cap 30, it will be appreciated by those skilled in the art that the lubricating strip can similarly be sequentially molded onto a plastic insert or other member which is later attached to a razor cap. Therefore, as used herein, the term "cap" encompasses any other part of the injection molded razor assembly which is formed before the molding of the lubricating strip and which partially defines the mold cavity in which the lubricating strip is formed.

Figure 3:
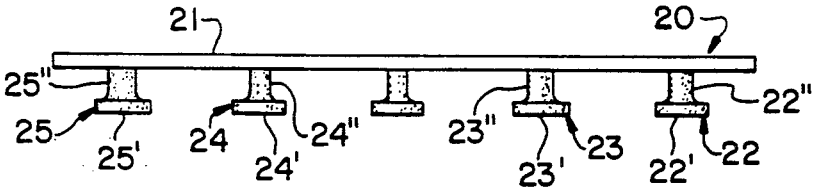
FIG. 3 is a view of a molded polyethylene oxide insert made according to this invention.

FIG. 3 illustrates the molded strip 20 as it would appear if separate from the cap 30. As can be seen therein, a series of T-shaped anchors including anchors 22, 23, 24 and 25 are formed with shapes corresponding to cap openings 12, 13, 14 and 15 respectively. The anchors 22, 23, 24 and 25 have neck portions 22'', 23'', 24'', 25'' which connect working surface 21 of lubricating strip 20 to anchor portions 22', 23', 24', 25', i.e. the cross bar portions of the T.

The particular configuration of the molded anchors are illustrative only and it will be appreciated by those skilled in the art that any suitable anchor design can be used. While the number of anchors utilized is not critical to providing the razor unit as a whole, is has been found that when there are at least four such anchors, and preferably five anchors positioned essentially symmetrically about the transverse center of the razor cap and substantially equidistant from each other, the forces applied as a result of the sequential cooling are substantially offset to minimize the amount of distortion to the caps. It is preferred to have an anchor located close to each end of the shaving aid strip in order to minimize any tendency for separation between the ends of the strip and the ends of the cap occasioned by the absorption of water by the strip. It will also be appreciated by those skilled in the art, that when an odd number of anchors are utilized, the middle anchor is preferably positioned near the center of the cap 30. In this manner, forces which may be applied to the strip 20 during shaving are adequately overcome and the strip 20 remains securely connected to the cap 30.

Figure 4:
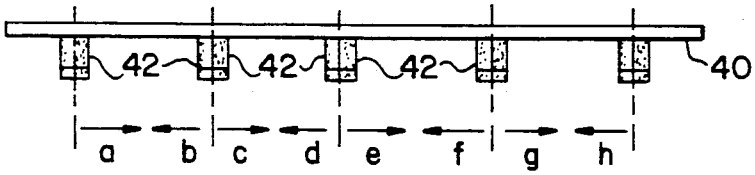
FIG. 4 is a diagrammatical representation of the forces imparted during cooling.

Referring to FIG. 4, a diagrammatic representation has been made to show force vectors counterbalancing each other so that minimum distortion results to the composite cooled product. In particular, a strip of shaving aid 40 is shown with five anchoring projections 42. When the strip is molded onto the skin engaging portion and permitted to cool, contractive forces a-b, c-d, e-f, and g-h are imposed on the skin-engaging portion Since the shaving aid strip has anchors which are substantially equidistant, the net effect is a balanced overall contraction which minimizes distortion in the resultant structure. It will be appreciated by those skilled in the art that greater support is generally provided by a higher number of anchors. As the number of anchors increases, the corresponding lengths of the razor cap segments between the anchors decrease. These shorter segments provide a greater resistance to bowing. As a result of the contractive forces exerted during cooling, it is believed that the shaving aid strip may experience a slight amount of stretching in the areas around the anchors.

The method of the present invention comprises the sequential molding of a razor cap 30 and, subsequently, a lubricating strip 20 in a pre-determined recess area 18 on the top of the cap. As can be seen by reference to the drawings, particularly FIGS. 1 and 2, a cap 30 is formed with a recess area 18 by injection molding and, subsequently a mixture of polystyrene and polyethylene oxide is injected in a second stage injection molding operation. Suitable amounts of acceptable plasticizers, e.g. from about 0.1 to 10% by weight of the polystyrene-polyethylene oxide plasticizer mixture may advantageously be included in the second injection.

The use of a plasticizer in the polystyrenepolyethylene oxide mixture may be desirable, especially when the cap is formed with an acetal polymer, to bring about a reduction in injection molding temperatures and pressures. The plasticizer is preferrably water soluble, compatible with polyethylene oxide, and also cosmetically acceptable. By "cosmetically acceptable" it is meant that the use of the plasticizer in the amounts of about 0.1 to 10% by weight of the polyethylene oxide-polystyrene mixture will not generally produce irritation to the skin of the majority of the users of the shaving implement. The plasticizer must also be substantially incompatible with polystyrene. If the plasticizer is imprisoned in the polystyrene matrix, the plasticizer will have no effect on the polyethylene oxide. Of course, plasticizers which are compatible with both polyethylene oxide and polystyrene, and which are also cosmetically acceptable may be used if present in relatively high levels but obviously this is undesirable because high levels of plasticizers could adversely affect both the polyethylene oxide fraction and the polystyrene portion.

The use of the plasticizers allows the utilization of substantially lower temperatures and pressures during processing while still producing a flowability of the polyethylene oxide without substantially reducing the molecular weight of the polyethylene oxide or adversely affecting the performance of the lubricating strip.

Examples of suitable plasticizers include polyethylene glycol particularly with a molecular weight between about 400 and 20,000, water soluble polypropylene glycol particularly with a molecular weight between about 400 and 4,000, water-soluble copolymers of ethylene and propylene oxide, water-soluble alkyl phenol ethoxylates, glycerine, sorbitol and water.

Preferred plasticizers include propylene glycol and octyl phenol ethoxylate with 9 moles of ethylene oxide. This latter plasticizer is commercially available under the trade name Triton X-100 from Rohm and Haas Company, Philadelphia, Pa. It is also possible to use water as a plasticizer although the use of water requires a change in certain process parameters. Particularly preferred plasticizers are propylene glycol and Triton X-100. With regard to each specific plasticizer, flowability at a given temperature increases with the amount of plasticizer added as shown in the following examples.

EXAMPLE 1

A series of injection moldings were made in which the levels of high molecular weight polyethylene oxide, polystyrene and propylene glycol were varied within the ranges shown in table I set forth below.

A small amount of 3,5,-di-tertbutyl-p-cresol, commonly known as butylated hydroxy toluene or BHT, was added to the composition as an oxidation inhibitor.

In order to determine the effect of plasticizers on the injection miolding temperatures, runs were conducted on a commercial injection molding machine. Temperatures of the different sections of the machine were varied to determine the minimum temperatures for sequentially molding lubricating strips when the skin-engaging portion contains an acetal polymer.

The table below presents the compositions tested in the manner described above, showing the minimum acceptable temperatures necessary for successful sequential molding of the lubricating strip containing acetal.

TABLE I

| COMPOSITION | | | | | MINIMUM ACCEPTABLE MOLDING MACHINE TEMPERATURES | | | | |
|---|---|---|---|---|---|---|---|---|---|
| Sample No. | Poly(styrene) % | Poly(ethylene-oxide), % | Propylene Glycol, % | BHT % | Rear °F. | Front °F. | Nozzle °F. | Sprue °F. | Mold °F. |
| 1 | 19.9 | 80 | 0 | 0.1 | 360 | 390 | 400 | 510 | 75 |
| 2 | 24.9 | 75 | 0 | 0.1 | 360 | 390 | 400 | 510 | 75 |
| 3 | 29.9 | 70 | 0 | 0.1 | 360 | 390 | 400 | 510 | 75 |
| 4 | 19.9 | 75 | 5 | 0.1 | 320 | 330 | 330 | 430 | 75 |
| 5 | 24.9 | 70 | 5 | 0.1 | 320 | 330 | 330 | 430 | 75 |
| 6 | 29.9 | 65 | 5 | 0.1 | 320 | 330 | 330 | 425 | 75 |
| 7 | 19.9 | 70 | 10 | 0.1 | 310 | 320 | 320 | 380 | 75 |
| 8 | 24.9 | 65 | 10 | 0.1 | 320 | 330 | 330 | 425 | 75 |

Table I shows that the introduction of 5% plasticizer enabled a reduction in the minimum acceptable injection molding machine temperatures of 40° F. at the rear of the machine injection barrel and 80° F. at the nozzle and sprue, Addition of 10% plasticizer enabled reduction in the minimum acceptable molding machine temperatures by 50° F. at the rear of the machine and 85°-130° F. at the nozzle and sprue. As used herein, "minimum acceptable molding machine temperatures" means the lowest temperature at which the material will flow with a reasonable injection pressure, e.g. 1000 psi, to adequately and consistently fill the mold cavities.

EXAMPLE 2

A two-minute water immersion laboratory test was used to evaluate the efficacy of inserts and assess their ability to release polyethylene oxide during shaving. A minimum of water weight gain is required for an insert to be efficacious, i.e. perceived as providing significant lubrication to the shaver during the act of shaving. Water immersion values for the above-listed compounds was as follows:

| Compound | % Weight Gain 2-Min. Water Immersion Test |
|---|---|
| 1 | 84 |
| 2 | 92 |
| 3 | 67 |
| 4 | 78 |
| 5 | 74 |
| 6 | 73 |
| 7 | 92 |
| 8 | 65 |

The table shows that when comparing Compound 3 (no plasticizer) to Compound 6 (5% propylene glycol) that the plasticized compound is more efficacious (73% water absorption vs. 67%) and that the plasticized compound can be molded at nozzle and sprue temperatures of 70° F. and 85° F., respectively, below the non-plasticized formulation.

The introduction of 10% propylene glycol (compare compound 1 to compound 7) correspondings permits a reduction in nozzle and sprue temperatures of 80° F. and 130° F., respectively, while slightly increasing efficacy.

We claim:

1. In a wet-shaving razor unit, a plastic skin-engaging portion having a length generally transverse the path direction of shaving with a shaving aid strip extending along the length of said skin-engaging portion comprising a substantially thermoplastic shaving aid strip formed on said plastic skin-engaging portion, said plastic skin-engaging portion having at least four openings arranged substantially equidistant apart for receipt of said shaving aid in a thermoplastic mass, and said shaving aid strip anchored to said skin-engaging portion by projections extending from said strip into said openings in said skin-engaging portions.

2. A razor unit of claim 1 wherein said skin-engaging portion is a razor cap and said openings define generally T-shaped anchoring orifices with the top of said T-shaped anchoring orifioes essentially parallel to said strip and the leg of said T-shaped anchoring orifices extending substantially perpendicular to and connecting said shaving aid strip and said top of said T-shaped anchoring orifices.

3. A razor unit of claim 1 wherein said strip is molded onto said skin-engaging portion after said skin-engaging portion has been molded.

4. A razor unit of claim 1 wherein said skin-engaging portion comprises at least five of said anchor openings arranged substantially equidistant along said length.

5. A razor unit of claim 1 wherein said strip is a lubricating strip comprising a mixture of polystyrene, polyethylene oxide and from 0.1 to 10% a water soluble, cosmetically acceptable plasticizer for polyethylene oxide said plasticizer being incompatible with polystyrene

6. A razor unit of claim 5 wherein said plasticizer is at least one member of a group consisting of propylene glycol, polyethylene glycol, polypropylene glycol, glycerol, alkyl phenol ethoxylate and water.

7. A razor unit of claim 1 wherein said strip is a lubricating strip comprising polystyrene, polyethylene oxide and between about 0.1 to about 10% by weight of propylene glycol.

8. A razor unit of claim 1 wherein said strip is a lubricating strip comprising a mixture of polyethylene oxide and polystyrene and between about 0.1 to about 10% by weight of octyl phenol ethoxylate containing nine moles of ethylene oxide.

9. A method of molding a wet-shaving razor unit in a wet-shaving razor unit comprising the steps of:

molding a plastic skin-engaging portion having a length generally transverse the path direction of shaving and at least four openings arranged substantially equidistant apart, and sequentially molding a shaving aid strip onto said skin engaging portion in a manner such that said shaving aid strip is anchored to said skin-engaging portion by projections extending from said strip into said openings in said skin-engaging portions.

10. A method according to claim 9 wherein said step of molding said skin-engaging portion comprises molding said skin-engaging portion in the form of a razor cap such that said openings defines generally T-shaped anchoring orifices with the top of said T-shaped anchoring orifices essentially parallel to said strip and the leg of said T-shaped anchoring orifices extending substantially perpendicular to and connecting said shaving aid strip and said top of said T-shaped anchoring orifices.

11. A method according to claim 9 wherein said step of molding said skin-engaging portion comprises forming said skin-engaging portion with at least five of said anchor openings arranged substantially equidistant along said length. length.

12. A method according to claim 9 wherein said strip is a lubricating strip comprising a mixture of polystyrene, cosmetically acceptable plasticizer for polyethylene oxide said plasticizer being incompatible with polystyrene.

13. A method according to claim 12 wherein said plasticizer is at least one member of a group consisting of propylene glycol, polyethylene glycol, polypropylene glycol, glycerol, alkyl phenol ethoxylate and water

14. A method according to claim 9 wherein said strip is a lubricating strip comprising polystyrene, polyethylene oxide and between about 0.1 to about 10% by weight of propylene glycol.

15. A method according to claim 9 wherein said strip is a lubricating strip comprising a mixture of polyethylene oxide and polystyrene and between about 0.1 to about 10% by weight of octyl phenol ethoxylate containing nine moles of ethylene oxide.

* * * * *